US007089703B2

(12) United States Patent
Brereton

(10) Patent No.: US 7,089,703 B2
(45) Date of Patent: Aug. 15, 2006

(54) ERECTABLE STRUCTURE

(75) Inventor: Anthony Paul Brereton, Widnes (GB)

(73) Assignee: Finecard International Limited, Cheshire (GB)

( * ) Notice: Subject to any disclaimer, the term of this patent is extended or adjusted under 35 U.S.C. 154(b) by 129 days.

(21) Appl. No.: 10/307,609

(22) Filed: Dec. 2, 2002

(65) Prior Publication Data

US 2003/0101660 A1 Jun. 5, 2003

(30) Foreign Application Priority Data

Dec. 4, 2001 (GB) ..... 0128988.3

(51) Int. Cl.
*E04H 15/22* (2006.01)
*E04G 11/04* (2006.01)

(52) U.S. Cl. ..... 52/2.23; 52/2.11; 52/2.17; 52/2.18; 52/2.24; 472/134

(58) Field of Classification Search ..... 52/2.11, 52/2.12, 2.13–2.14, 2.17–2.18, 2.22, 2.23, 52/2.24; 446/220, 221, 89, 478, 267; 472/134, 472/136–137; 135/90, 97; 412/134, 136, 412/137

See application file for complete search history.

(56) References Cited

U.S. PATENT DOCUMENTS 2,910,994 A * 11/1959 Joy ..... 52/2.11
4,103,369 A * 8/1978 Riordan ..... 52/2.14
4,340,626 A * 7/1982 Rudy ..... 428/35.7
5,331,991 A * 7/1994 Nilsson ..... 135/93
5,425,677 A * 6/1995 Gleeson et al. ..... 472/136
5,471,797 A * 12/1995 Murphy ..... 52/2.17
5,487,400 A * 1/1996 Dawkins ..... 135/87
5,579,609 A * 12/1996 Sallee ..... 52/2.11
5,603,185 A * 2/1997 Murphy ..... 52/2.17
5,678,357 A * 10/1997 Rubio et al. ..... 52/2.17
5,970,661 A * 10/1999 Bishop et al. ..... 52/2.11
6,008,938 A * 12/1999 Suehle et al. ..... 359/443
6,192,633 B1 * 2/2001 Hilbert ..... 52/2.18
6,263,617 B1 * 7/2001 Turcot et al. ..... 52/2.18
6,554,013 B1 * 4/2003 Brown ..... 135/93
6,565,405 B1 * 5/2003 Hsu et al. ..... 446/89
6,875,119 B1 * 4/2005 Murphy et al. ..... 472/134

* cited by examiner

*Primary Examiner*—Carl D. Friedman
*Assistant Examiner*—Yvonne M. Horton
(74) *Attorney, Agent, or Firm*—Gauthier & Connors LLP

(57) ABSTRACT

An erectable play structure for children including one or more enclosures or pods (10, 11, 12) which may be interconnected by one or more access tunnels (14) the whole structure being formed predominantly from a non-self supporting material thus to be collapsible for storage and adapted to be connected to an air pump (18) whereby the internal pressure within the structure may be slightly in excess of ambient pressure thus to maintain the structure in an erect condition. One or more access ports (15, 16) and/or blanking plates (17) may be provided in each enclosure to allow or prevent access to or exit from the enclosure. The access ports (16) are constructed such that after passage there through they resume a closed condition to resist escape of air therethrough. Hook and loop fasteners or the like are used to attach the enclosures, tunnels and access ports together in assembly of the structure.

14 Claims, 4 Drawing Sheets

ERECTABLE STRUCTURE

THIS INVENTION concerns erectable structures, particularly though not exclusively a play structure for children and including one or more enclosures or pods which may be inter-connected by one or more access tunnels, the whole structure being formed predominantly from a non-self supporting material thus to be collapsible for storage.

Some such known structures are maintained in an erect condition by a framework of a flexible material such as spring steel which however may be twisted and folded into a number of compact rings for storage but which when released spring open to form the structure, the walls of which are made from a fabric or other flexible material. These structures are extremely popular since in the erect condition they provide ample space for occupancy, yet they can be readily collapsed for storage in a compact form.

An object of the present invention is to provide an erectable structure which, predominately, does not rely upon a sprung framework for support and which, instead, relies upon the establishment of air pressure within the structure.

According to the present invention there is provided an erectable structure comprising a plurality of enclosures inter-connected by at least one access tunnel; characterised in that the walls of the structure are predominantly of a non-self supporting material thus to be capable of assuming a folded or collapsed state for storage; in that an air pump is connectable to the structure to inflate same to an erect condition for occupancy; and in that at least one air flow resistant port is provided for access to and from the structure while the erect condition is maintained.

The or each access tunnel is preferably detachable from the enclosures for storage.

The or each access tunnel may be supported by a flexible annular frame.

An escape flap may be provided in the wall of the or each access tunnel enabling an occupant to escape readily from the tunnel in an emergency.

An embodiment of the invention will now be described, by way of example only, with reference to the accompanying drawings in which.

Figure 1:
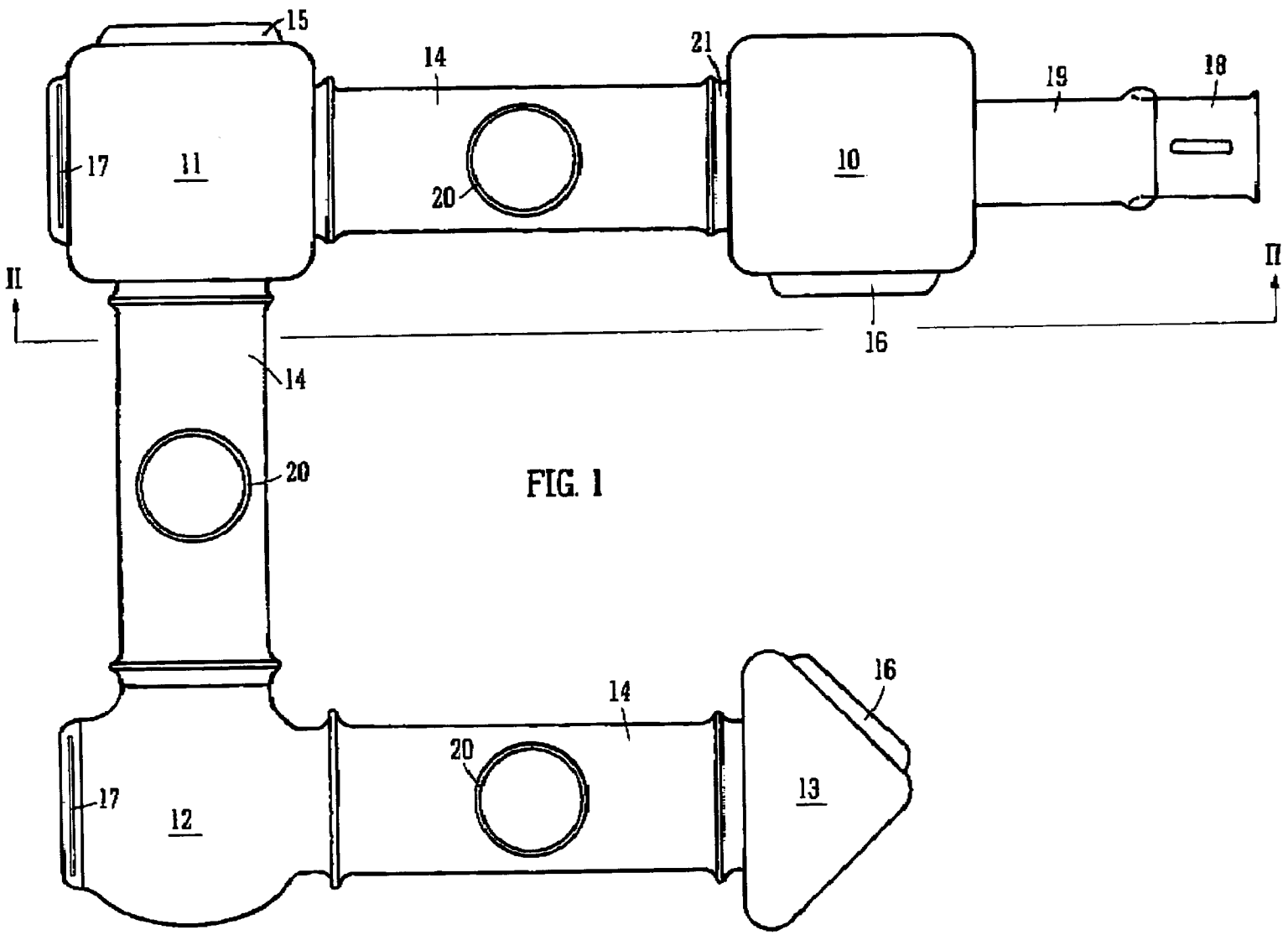
FIG. 1 is a schematic plan view of an erectable structure made in accordance with the invention.
Figure 2:
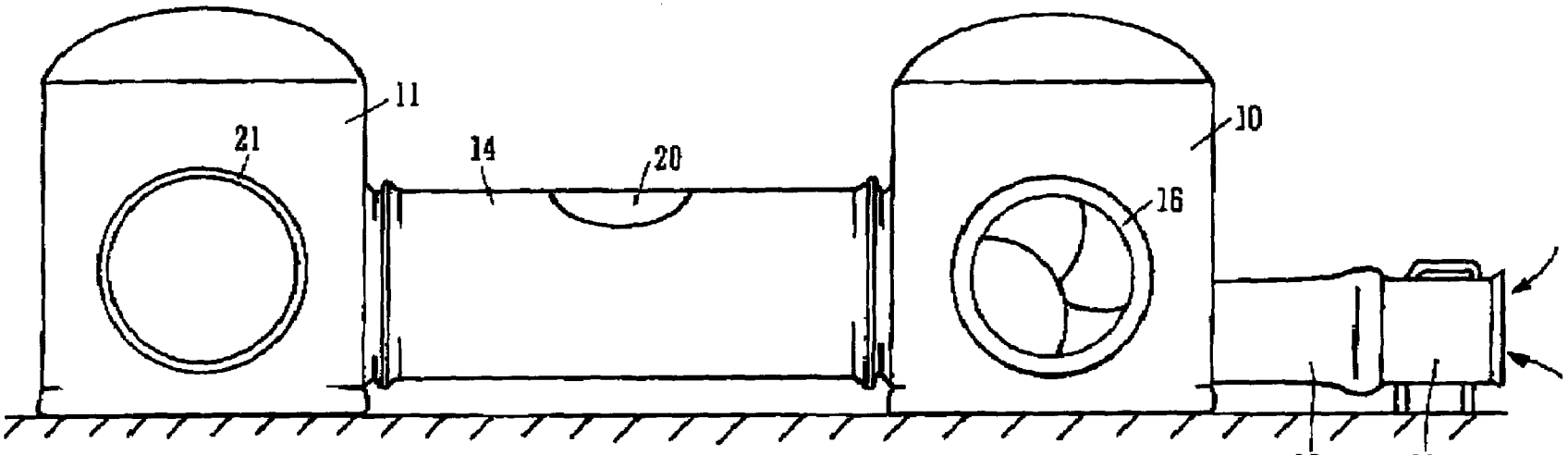
FIG. 2 is a schematic elevation taken on line II—II of FIG. 1.

Referring now to the drawings which illustrate an erectable structure providing a child's play area, the structure, in this example, comprises four pods or enclosures 10, 11, 12 and 13 of sufficient size to be occupied by a child or adult standing, kneeling, or sitting interconnected by a plurality of access tunnels 14.

As will be described, the pods and tunnels may be connected together in a number of different configurations as required to make up the overall play structure. Also, the means of attachment of the tunnels to the pods enables the structure to be readily erected and collapsed, and the parts of the structure are predominantly of a flexible and thus foldable and collapsible material such as a synthetic or natural fabric, so that they may be stored in a compact manner when required.

Each of the pods is provided with one or more ports 15 to which may be connected an access tunnel or an access member. In the example shown an access member 16 is connected to the pod 10 and access tunnels 14 are connected between the pods 10 and 11, 11 and 12 and 12 and 13 respectively.

Ports 15 which are not otherwise connected to a tunnel or an access member may be closed, for example, by a blanking plate 17. A further access member 16 is shown connected to pod 13.

In this example therefore access to the structure may be, achieved via pod 10 or pod 13 and further access is provided between the pods 10, 11, 12 and 13, via the tunnels 14.

Once the parts are connected as described and illustrated, the whole structure may be inflated by an air pump 18 connected by duct 19 to the interior of the pod 10. The pods 11, 12 and 13 may be provided with similar connecting points for an air pump. The pump 18 is of sufficient working capacity to establish and maintain an air pressure within the structure which is above ambient pressure so that the entire structure assumes a substantially erect condition until such time as the pump 18 is switched off.

One or more escape flaps 20 are provided, preferably one in each access tunnel 14, and these flaps are maintained in contact with the tunnel walls only by strips of hook and loop fastener e.g. VELCRO (registered trade mark) or the like thus to be readily detachable should it be necessary to provide an escape passage from a tunnel in an emergency.

Figure 3:
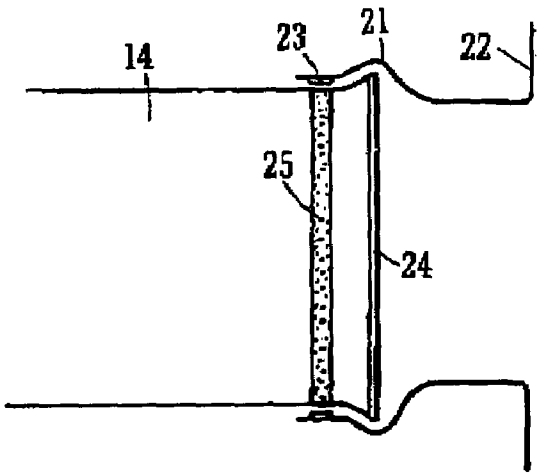
FIG. 3 is an enlarged elevation showing a manner of attachment of parts of the structure to one another.

Referring now to FIG. 3, the manner of attachment, at each port 15, of an access tunnel 14, an access member 16 or a blanking plate 17, is provided by a flexible annular collar 21 attached to the wall 22 of a respective pod, and having attached thereto an annular strip comprising one part of a VELCRO fastener 23.

At each end of each access tunnel 14 is a stiffening hoop 24 which serves to maintain the required circular shape of the access tunnel. Attached to the outer wall surface of the tunnel adjacent the hoop 24 is the other part 25 of the VELCRO fastener. Thus, by joining the two parts 23 and 25 of the fastener a substantially air flow-resistant seal is provided in the wall between the interior of the pod and that of the tunnel.

Figure 4:
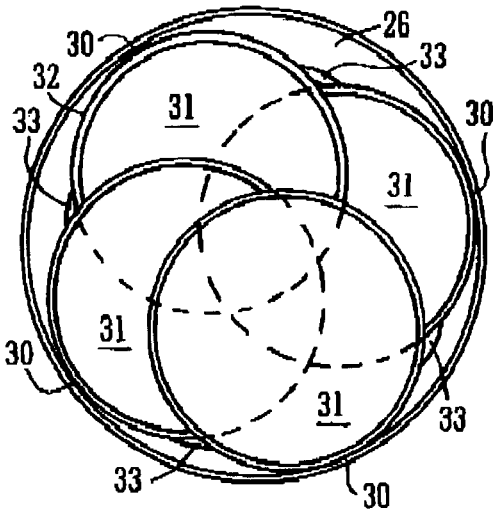
FIG. 4 is an enlarged external view of an access member of the structure.

Referring now to FIG. 4, each access member 16 which may be referred to as a 'door set', comprises an annular part 26 of a flexible material surrounded by a semi-rigid hoop 27 and defining a central access passage 28. Strips 29 of VELCRO fastener are provided on the annular part 26.

Figure 6:
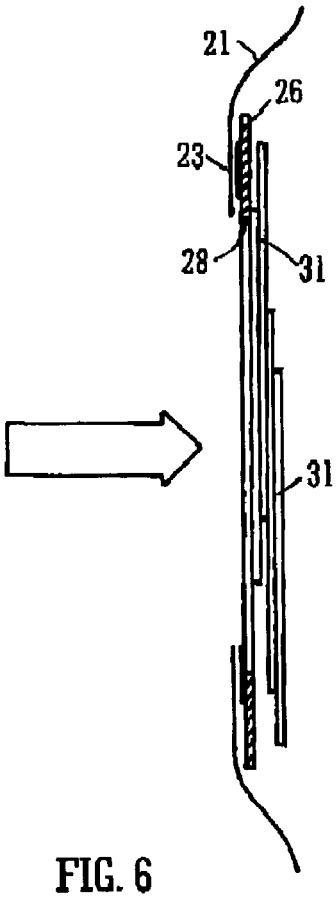
FIG. 6 is an enlarged elevation, similar to FIG. 3 but showing the manner of attachment of an access member to the structure.

Thus, as can be seen in FIG. 6 the access member 16 may be attached to the VELCRO fastener 23 of a collar 21 in place of an access tunnel 14.

Figure 5:
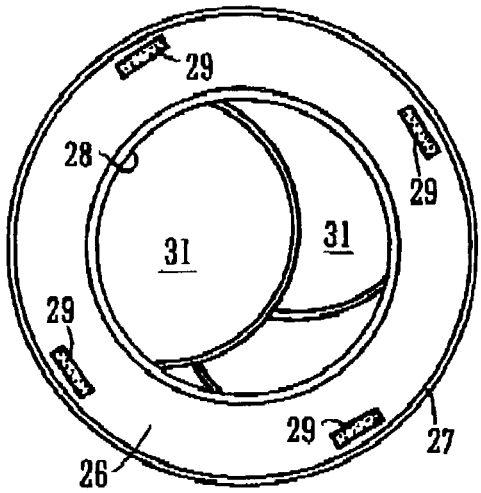
FIG. 5 is an internal view of the access member.

Referring now to FIG. 5, there is stitched at 30 to the inner face of the annular part 26 a plurality of discs 31 arranged in mutually overlapping relationship. Each disc 31 may be of a similar material to the annular part 26 and bounded by a semi-rigid frame 32. Alternatively the discs 31 may be of a rigid material. Elastic strips 33 connect together circumferential parts of the respective overlapping discs 31.

Thus, passage through the door set into or out of the enclosures is achieved through the passage 28, by pushing the discs 31 aside. The discs subsequently return to the closed condition by virtue of the elastic strips 33. During passage through a door set, there is a certain loss of internal air pressure, which may cause some relaxation of the entire structure. While this relaxation may be visible nevertheless like structure remains substantially erect and returns to its fully inflated condition once the door set closes and internal pressure is re-established.

Blanking plates 17 may be formed as disc-like members similar to the door set illustrated in FIG. 4 but without an access passage 28 and without overlapping discs 31.

Indeed, door sets similar to that illustrated at 16 may be provided at each port not otherwise occupied by an access tunnel so that entry and access to the structure may be effected at a number of positions.

The walls of the pods and the tunnels may be entirely or partially transparent or decorated with suitable indicia according to the intended theme of the structure.

The door set illustrated in FIGS. 5 and 6, being a detachable item, may be used with other forms of play structure such as those which are maintained in an erect condition by a sprung frame, but they have particular application in the present case where the provision of overlapping discs enables access to the structure while the erect condition of the structure is maintained. The use of VELCRO fastener on all ports also serves to maintain the air pressure within the structure, only minimal bleeding of air being permitted around the ports and around the escape flaps 20.

Figure 7A:
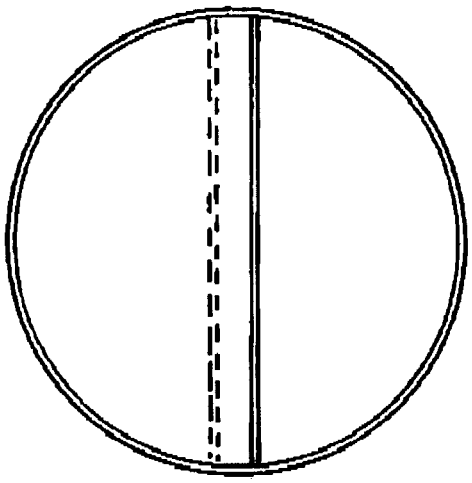
FIG. 7*a* to 7*c* are views similar to FIG. 4, but showing three alternative forms of access member.
Figure 7B:
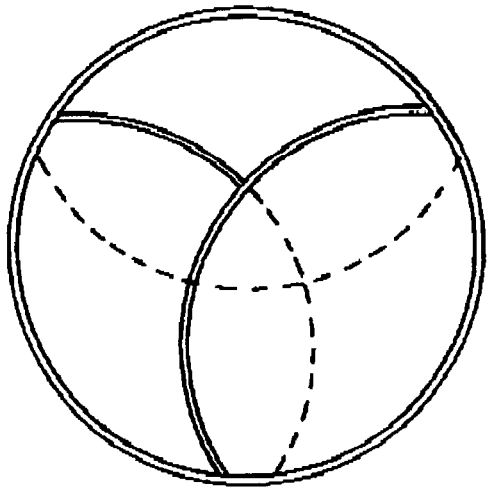
Figure 7C:
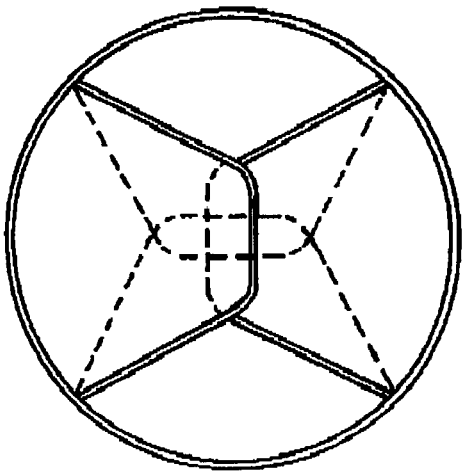

Each door set conveniently comprises four overlapping discs 31 but in some applications as few as three or even two larger discs would suffice provided they overlap sufficiently to serve as a closure for access passage 28. FIGS. 7*a* to 7*c* illustrate three alternative arrangements of overlapping plates for the door sets. In FIG. 7*a* there are two overlapping sheets which may be parted like curtains but which are elasticated so that they resume an airflow resistant closure. FIG. 7*b* has three circular discs in place of the four discs shown in FIG. 5, and FIG. 7*c* has four overlapping plates each of a trapezoidal shape.

The invention claimed is:

1. An erectable structure comprising a plurality of enclosures interconnected by at least one access tunnel to define an overall enclosed interior air space at least of sufficient size to be occupied by a child; characterized in that the walls of the structure are predominantly of a non-self supporting material thus being capable of assuming a folded or collapsed state for storage; in that an air pump is connectable to said overall enclosed interior air space to inflate and hold the enclosures in an erect condition for occupancy only by an overpressure in said overall interior air space; and in that at least one air flow resistant access port is provided for access to and exit from said overall interior air space while the erect condition of the structure is substantially maintained.

2. An erectable structure according to claim 1, wherein the access tunnel is detachable from the enclosures for storage.

3. An erectable structure according to claim 1, wherein the access tunnel is supported by a flexible annular frame.

4. An erectable structure according to claim 1, including an escape flap in the wall of the access tunnel such as to enable an occupant to escape readily from the tunnel in an emergency.

5. An erectable structure according to claim 1, wherein said at least one airflow resistant access port comprises an access member having overlapping means which provide airflow resistance across the port but which are temporarily movable to allow passage through the port.

6. An erectable structure according to claim 5, wherein said overlapping means are elastically maintained in overlapping relationship.

7. An erectable structure according to claim 5, wherein the access member is detachable from the structure.

8. An erectable structure according to claim 1, wherein the interior of each enclosure is of sufficient size to be occupied by a child or adult standing, kneeling or sitting therewithin.

9. An erectable structure according to claim 1, wherein the access tunnel is attachable to the enclosures by means of hook and loop fastener.

10. An erectable structure according to claim 1, made from a material which is adapted to be maintained in an erect condition by means of an air pump adapted to maintain an internal air pressure within said interior which is in excess of the external ambient air pressure.

11. An erectable structure according to claim 1, wherein each enclosure is provided with a plurality of access ports each connectable selectively to an access tunnel or to a removable airflow resistant access member or blanking plate.

12. An erectable structure according to claim 1, wherein the enclosures and the access tunnel are made from a fabric or other flexible material and wherein one or more parts of the fabric or flexible material are translucent.

13. An erectable structure according to claim 12, wherein said one or more translucent parts of the fabric or flexible material are transparent.

14. An erectable structure according to claim 1, wherein the enclosures and the access tunnel are made from a fabric or other flexible material and wherein on or more parts of the fabric or other flexible material are decorated according to an intended theme of the structure.

* * * * *